United States Patent [19]

Guscott

[11] Patent Number: 4,608,674

[45] Date of Patent: Aug. 26, 1986

[54] CONSTANT RANGE ULTRASONIC MOTION DETECTOR

[75] Inventor: John K. Guscott, Lynnfield, Mass.

[73] Assignee: American District Telegraph Company, New York, N.Y.

[21] Appl. No.: 406,020

[22] Filed: Aug. 6, 1982

[51] Int. Cl.[4] ..... G08B 13/16; G08B 29/00

[52] U.S. Cl. ..... 367/93; 340/501; 367/94

[58] Field of Search ..... 367/93, 94; 340/501

[56] References Cited

U.S. PATENT DOCUMENTS

| | | | |
|---|---|---|---|
| 3,838,408 | 9/1974 | McMaster | 367/94 |
| 4,420,746 | 12/1983 | Malinowski | 340/501 |
| 4,479,113 | 10/1984 | McNeilly et al. | 340/501 |

*Primary Examiner*—Glen R. Swann, III

*Attorney, Agent, or Firm*—Weingarten, Schurgin, Gagnebin & Hayes

[57] ABSTRACT

A constant range ultrasonic motion detector features an ambient atmospheric condition sensor which senses the temperature, pressure, and percent relative humidity of the ambient atmosphere and produces therefrom a range compensation signal to adjust the sensitivity of the ultrasonic motion detector for stabilizing the range. The range compensation signal is applied to adapt detector amplifier gain and/or threshold level to the variation between design and ambient conditions. In one embodiment, an analog summing network at the ambient atmospheric sensor outputs provides the range compensation signal and in a second embodiment a microprocessor is operative to provide the range compensation signal.

22 Claims, 9 Drawing Figures

CONSTANT RANGE ULTRASONIC MOTION DETECTOR

FIELD OF THE INVENTION

This invention is drawn to the field of intrusion detection systems, and more particularly, to a novel constant range ultrasonic motion detector.

BACKGROUND OF THE INVENTION

Ultrasonic motion detectors project and receive ultrasonic sound energy in a region of interest. Object motion within the region of interest and in the range of the ultrasonic motion sensor is detected and an alarm signal representative thereof is produced. The actual or effective range of ultrasonic motion detectors, however, differs from design range whenever the actual ambient atmospheric sound propogation conditions vary from the design or nominal atmospheric conditions. False alarms are produced should the ambient atmospheric conditions be such as to provide an effective range that is greater in spatial extention than the design range. In this case, object motion is detected that arises beyond the region of interest. A failure of alarm situation occurs should the ambient atmospheric conditions be such as to produce an effective range that is spatially less extended than the design range. In this case, object motion within the region of interest, but beyond the actual range of the detector, goes undetected.

SUMMARY OF THE INVENTION

The range stabilized ultrasonic motion detector of the present invention senses such ambient atmospheric sound propagation conditions as relative humidity, temperature, and atmospheric pressure and produces and applies a range correction signal to the ultrasonic motion detector to correct the range variation introduced by the difference between the nominal and the ambient sound transmission propagation parameters of the atmosphere. Both false alarms and a failure of alarm occasioned respectively by more and by less actual ultrasonic motion sensor range than nominal are substantially eliminated. The ultrasonic motion detector produces a Doppler detect signal in response to object motion which is amplified and converted to a direct current level and applied to an alarm threshold comparator. Range is stabilized by varying the sensitivity of the ultrasonic motion detector either by controlling amplifier gain or comparator level to compensate for ambient atmospheric induced changes in the nominal range. One embodiment uses a microprocessor responsive to the ambient atmospheric sound propagation determining conditions and operative to compute either the alarm comparator threshold value or the amplifier gain which adapts the sensitivity of the ultrasonic motion detector to stabilize the range. Another embodiment uses an analog summing network at the ambient atmospheric sensor outputs to adapt the ultrasonic motion detector sensitivity to ambient atmospheric-induced range variation.

BRIEF DESCRIPTION OF THE DRAWINGS

The invention will become better understood by reference to the following exemplary and nonlimiting detailed description of the preferred embodiments, and to the drawings, wherein.

DETAILED DESCRIPTION OF THE PREFERRED EMBODIMENTS

Figure 1:
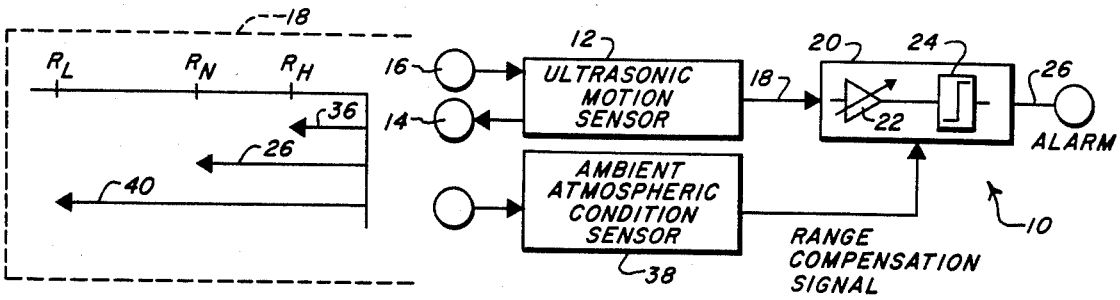
FIG. 1 is a block diagram of a novel constant range ultrasonic motion detector of the present invention.

Referring now to FIG. 1, generally designated at 10 is a block diagram of a novel constant range ultrasonic motion detector of the present invention. The ultrasonic motion detector 10 includes an ultrasonic motion sensor 12 having a transmitting transducer 14 and a receiving transducer 16. The ultrasonic motion sensor 12 is responsive to the transmitted and received sound energy and operative to provide a Doppler detect signal representative of object motion within a spatial region designated by a dashed line 18. A detector electronics module 20 includes an amplifier 22 for amplifying the Doppler detect signal which is connected to an alarm comparator 24. The detector electronics module 20 is operative to produce an alarm indication whenever the amplified magnitude of the Doppler detect signal exceeds a noise threshold.

The nominal range ($R_N$) of the ultrasonic motion sensor 12 is designated by an arrow 26. The nominal range is the normal or design range that is obtained for an assumed set of parameters including frequency of operation, relative humidity, temperature, pressure, and other such variables that determine the attenuation coefficient for sound wave propagation. By way of example and not of limitation, the points designated 28 on the curves 30, 32, and 34 of FIGS. 2A, 2B, and 2C correspond to such a design range for system operation at a nominal barometric pressure of thirty inches of mercury, at a nominal atmospheric temperature of sixty nine degrees Fahrenheit, and at a nominal forty three percent relative humidity factor, respectively. Each of the curves 30, 32, and 34 is plotted for a 26.3 Khz frequency of operation.

Figure 2A:
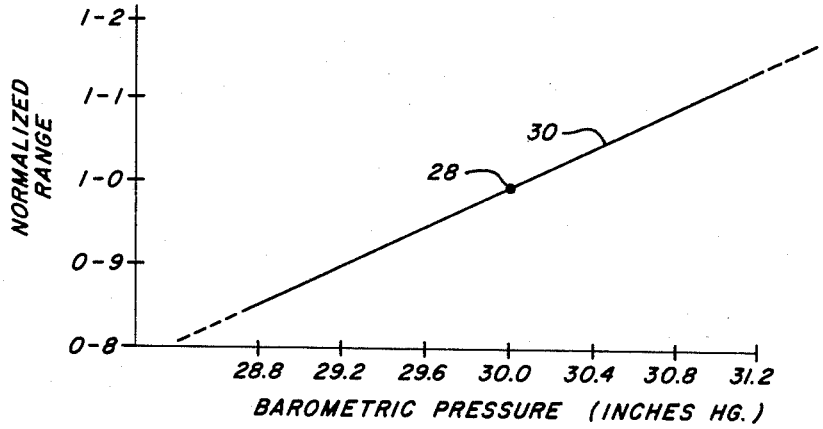
FIG. 2 shows in FIG. 2A a graph showing the range varying effect of ambient barometric pressure, in FIG. 2B a graph showing the range varying effect of ambient temperature, and in FIG. 2C a graph showing the range varying effect of ambient relative humidity.
Figure 2B:
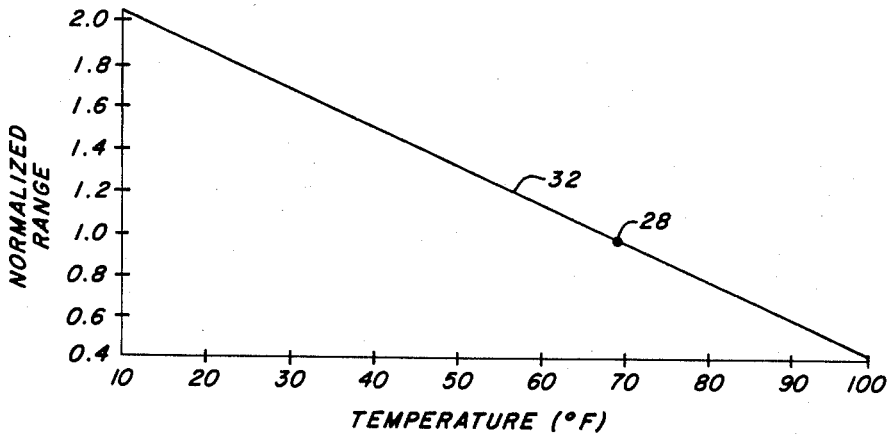

Whenever the ambient atmospheric conditions are such that the ultrasonic motion sensor 12 is operating in a regime characterized by the region of the curve 30 of FIG. 2A to the left of the point 28 and by the region of the curve 32 of FIG. 2B to the right of the point 28, soundwave attenuation is higher than nominal resulting in an actual sensor range that is less than the nominal range as designated by an arrow 36 of FIG. 1. The arrow 36 extends to a high attenuation range ($R_H$) which is less than the nominal range, $R_N$. In these instances, the failure of alarm that would be occasioned by the omission to provide an alarm signal for object motion within the spatial region between the arrow 26 and the arrow 36 is substantially eliminated by an ambient atmospheric condition sensor 38. Sensor 38 is operative to provide a range compensation signal which controllably varies the sensitivity of either the amplifier 22 or the threshold 24 of the detector electronics 20 in a manner that effectively extends the range whenever ambient conditions are such as to produce higher than nominal soundwave attenuation.

Figure 2C:
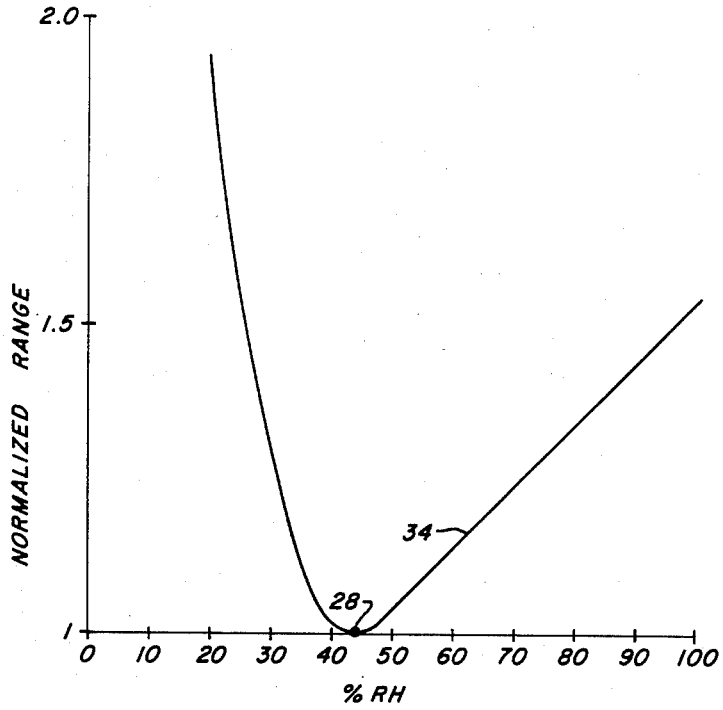

Whenever the ambient atmospheric conditions are such that the ultrasonic motion detector is operating in a regime characterized by the region of the curve 30 of FIG. 2A to the right of the point 28, by the region of the curve 32 of FIG. 2B to the left of the point 28, and the regions to both the left and to the right of the point 28 of the curve 34 of FIG. 2C, soundwave attenuation is lower than nominal resulting in an actual sensor range that is greater than the nominal range as designated by an arrow 40 of FIG. 1. The arrow 40 extends to a low attenuation range ($R_L$) which is greater than the nominal range, $R_N$. The false alarms that would be occasioned by the provision of an alarm signal for object motion beyond the nominal range in the spatial region between the arrow 26 and the arrow 40 are substantially eliminated by the ambient atmospheric condition sensor 38 which provides, in these instances, a range compensation signal to the detector electronics 20 that controllably varies the sensitivity thereof in a manner to effectively contract the actual range.

Figure 3A:
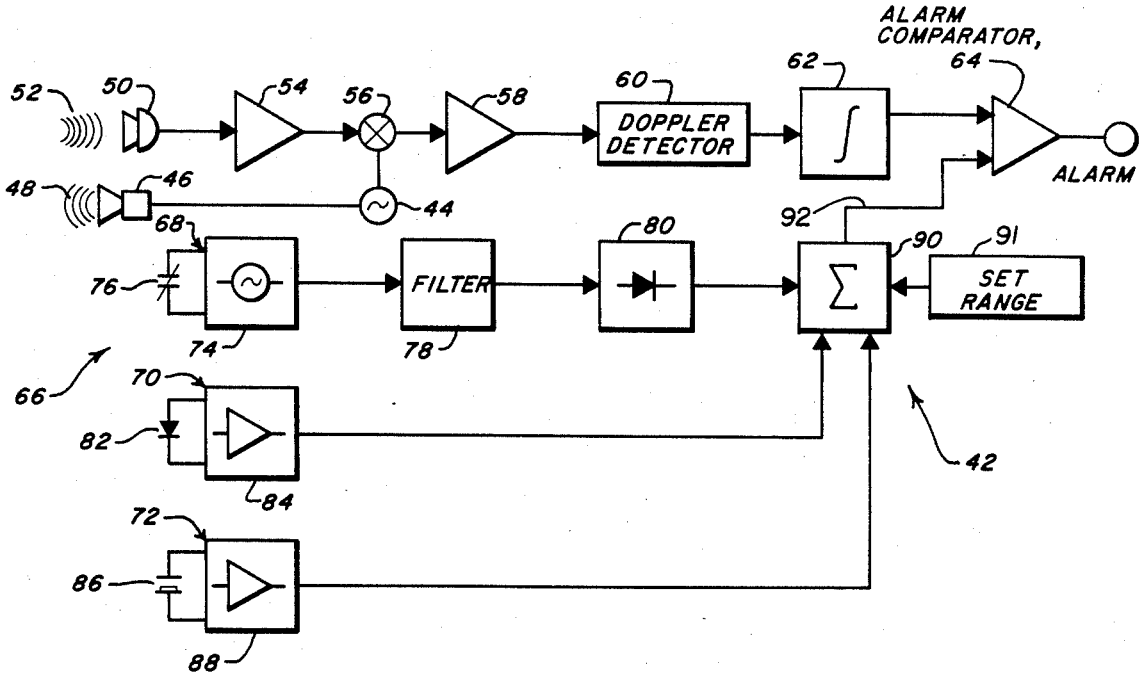
FIG. 3 shows in FIG. 3A a schematic diagram of one embodiment, shows in FIG. 3B another embodiment, and shows in FIG. 3C a further embodiment of the constant range ultrasonic motion detector of the present invention.
Figure 3B:
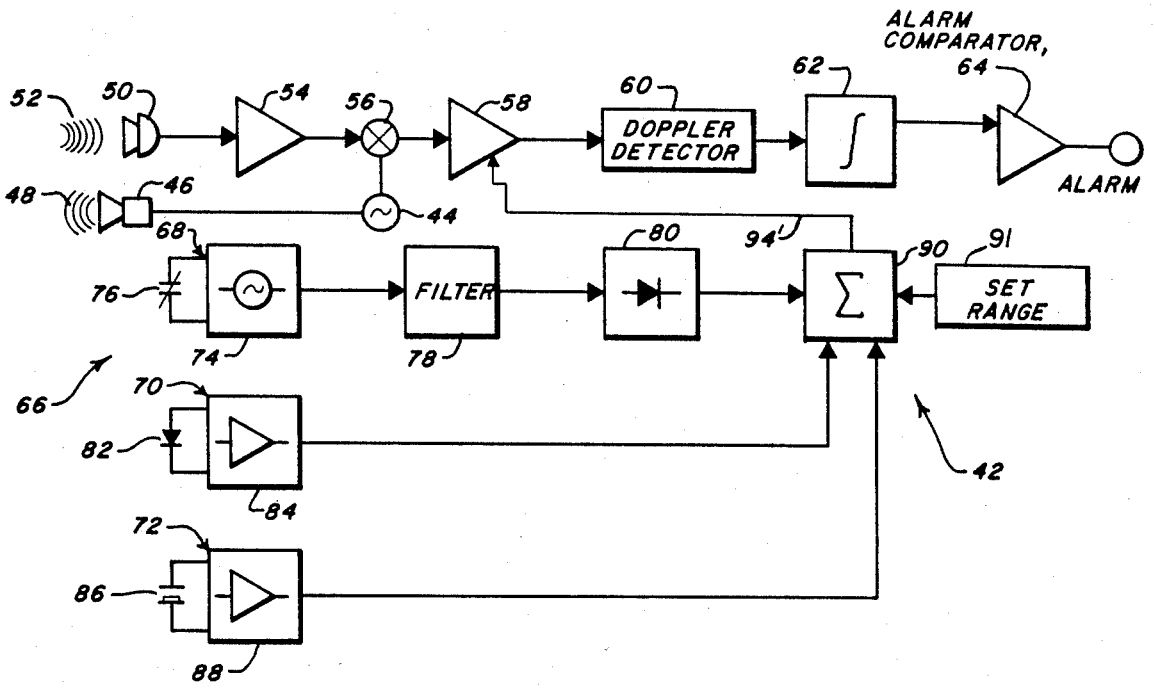
Figure 3C:
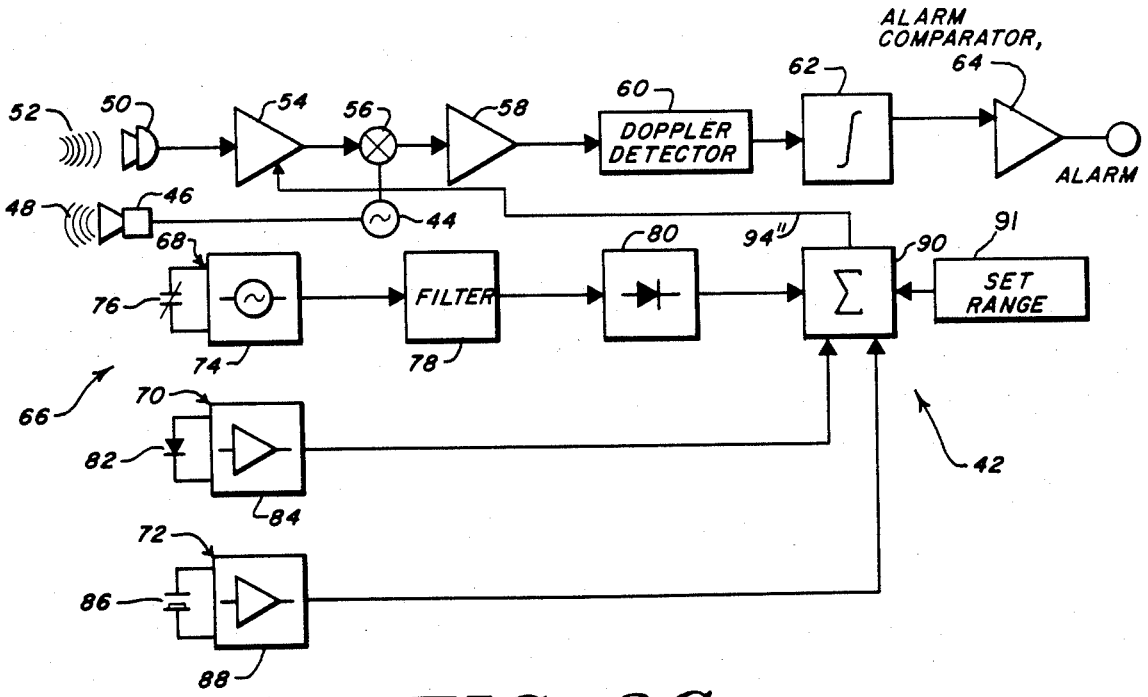

Referring now to FIG. 3, generally designated at 42 is one embodiment of the novel constant range ultrasonic motion detector according to the present invention. The constant range ultrasonic motion detector 42 includes an oscillator 44 driving a transducer 46 for projecting sound energy 48 at ultrasonic frequency into a region of interest. A receiving transducer 50 is responsive to sound energy 52 received from the region of interest and produces an electrical signal representative thereof. The electrical signal is amplified in an amplifier 54 and is mixed in a mixer 56 with the signal produced by the oscillator 44. The mixer 56 provides a signal containing the difference frequency intermodulation product of the received and the projected sound energy. The presence of object motion within the region of interest produces a Doppler signal having a characteristic frequency proportional to object velocity according to the Doppler principle; the absence of object motion within the region of interest produces a DC level out of the mixer 56.

An amplifier 58 is connected to the output of the mixer 56 which amplifies the output signal of the mixer 56. The amplified signal is applied to a Doppler detector 60. Detector 60 produces, in a known manner, a DC signal whose amplitude is representative of the Doppler signal. An integrator 62 is connected to the detector 60. The level of the integrator 62 output signal is representative of object motion within the region of interest. One input of an alarm threshold comparator 64 is connected to the integrator 62 output signal.

An ambient atmospheric sensor generally designated 66 includes a relative humidity sensor generally designated 68, a temperature sensor generally designated 70, and a pressure sensor generally designated 72. The temperature, pressure, and relative humidity atmospheric parameter sensors are representative and a greater or lesser number of particular ambient atmospheric parameter sensors may be employed. It is noted that, as used herein, the term "sensor" is to be construed to designate one or more particular ambient atmospheric sensors.

The relative humidity sensor 68 may advantageously be composed of an oscillator 74 controllable in frequency by a variable capacitor 76, the capacitance of which is proportional to ambient relative humidity of the atmosphere. The output signal of the capacitively controlled oscillator 74 has a frequency which represents ambient relative humidity and is applied to a filter 78. The amplitude to frequency response characteristic of the filter 78 is selected to be similar in form to the normalized range to percent relative humidity curve of FIG. 2C to provide a filtered output signal having a voltage to frequency dependence that follows the normalized range to percent relative humidity curve 34 of FIG. 2C. A rectifier 80 is connected to the filter 78 and produced a DC signal whose level is representative of the ambient percent relative humitidy of the atmosphere.

The temperature sensor 70 may advantageously be a temperature-sensitive semiconductor device 82 of known design operatively connected to an amplifier 84. The temperature sensor 70 provides a DC signal with an amplitude to temperature response that follows the form of the normalized range to temperature curve 32 of FIG. 2B. The temperature sensor 70 produces a DC signal whose level is representative of the ambient temperature of the atmosphere.

The pressure sensor 72 may advantageously be composed of a pressure sensitive semiconductor device 86 of known design operatively connected to an amplifier 88. The pressure sensor 86 provides a DC signal with an amplitude-to-pressure response that follows the form of the normalized range to pressure curve 30 of FIG. 2A. The pressure sensor 72 produces a DC signal whose level is representative of the ambient pressure of the atmospheric sound propagation medium.

An analog summing amplifier 90 is connected to the signal representative of ambient percent relative humidity provided by the relative humidity sensor 68, to the signal representative of ambient temperature provided by the temperature sensor 70, and to the signal representative of ambient pressure provided by the pressure sensor 72. As designated at 91, nominal range is selected by adjusting the gain of the amplifier 90. The summing amplifier 90 adds and weights the signals representative of ambient atmospheric conditions to provide a range compensation signal the level of which depends upon the variation between the ambient and the selected nominal sound propagation characteristics of the atmosphere.

The range of the ultrasonic motion detector is stabilized by adjusting the sensitivity of the detector electronics. This is accomplished either by applying the range compensation signal over the line 92 to the threshold comparator 64 to adapt the threshold to follow variations in ambient atmospheric condition or by applying the range compensation signal to either of the amplifiers 54 and 58 to adapt the amplifier gain to follow variations in atmospheric condition as is illustrated by the lines 94', 94" in FIGS. 3B, 3C, or to both, not illustrated. In the former case, the analog summing network provides a range compensation signal whose magnitude is comparatively less whenever the ambient sound propagation condition of the atmosphere produces an attenuation which is greater than nominal and whose magnitude is comparatively higher whenever the ambient sound propagation condition of the atmosphere produces an attenuation which is less than nominal. If the gain of the signal amplifiers of the ultrasonic motion detector is adapted to ambient conditions, the summing amplifier 90 provides a range compensation signal whose magnitude is comparatively higher whenever the ambient sound propagation condition of the atmosphere produces an attenuation which is greater than nominal and whose magnitude is comparatively lower whenever the ambient sound propagation condition of the atmosphere produces an attenuation which is less than nominal. Both false alarms and a failure of alarm situation are thereby substantially eliminated.

Figure 4:
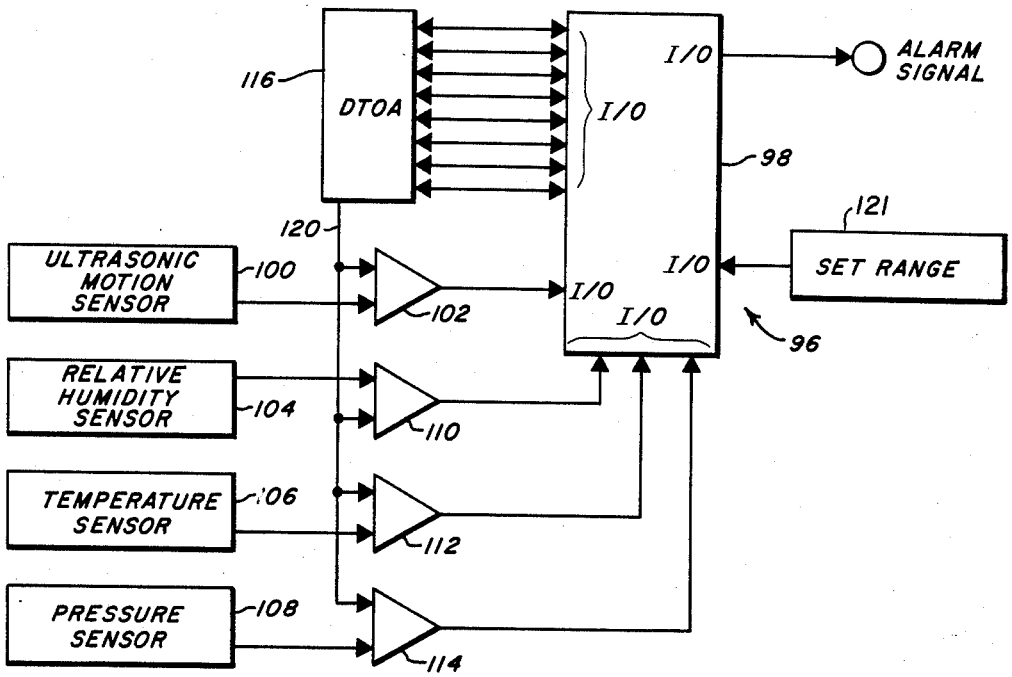
FIG. 4 is a schematic diagram of an alternate embodiment of the constant range ultrasonic motion detector of the present invention.

Referring now to FIG. 4, generally designated at 96 is another embodiment of the novel constant range ultrasonic motion detector according to the present invention. The constant range ultrasonic motion detector 96 includes a microprocessor 98. An ultrasonic motion sensor 100 is connected to one input of an alarm comparator 102 the output of which is connected to an I/O terminal of the microprocessor 98. The ultrasonic motion sensor 100 can be the same as the ultrasonic motion detector shown in FIG. 3 and may advantageously include elements 44, 46, 50, 54, 56, 58, 60, and 62 thereof. Ambient atmospheric condition sensors 104, 106, and 108 are respectively connected to one input of sensor comparators 110, 112, and 114, the output of each of which is connected to respective I/O terminals of the microprocessor 98. The ambient atmospheric condition sensors 104, 106, and 108 can be the same as the ambient atmospheric condition sensors 68, 70 and 72 shown and described in FIG. 3. A digital-to-analog convertor (DTOA) 116 is connected to eight I/O terminals of the microprocessor 98. An output terminal of the DTOA 116 is connected over a line 120 to the other input of the alarm comparator 102, and to the other inputs of the sensor comparators 110, 112, and 114. As designated at 121, the nominal range is selected via a dedicated I/O terminal of the microprocessor 98.

The processor 98 is operative to sequentially examine the signals produced by the ambient atmospheric condition sensors 104, 106, and 108 for measuring and storing a digital representation of the levels thereof in internal RAM registers not specifically illustrated. The processor is then operative to sequentially recall each of the digital values from the RAM registers. For each ambient value of the particular parameter sensed, the processor is operative to obtain from a ROM look-up table, not specifically illustrated, having data that represents the curves 30, 32, and 34 of FIGS. 2A, 2B, and 2C, the range data that corresponds to ambient conditions. From the variations between the nominal and the actual range, the processor is operative to compute a threshold voltage ($V_T$) which is applied to the alarm threshold comparator 102 over the line 120 which adapts the level thereof to the variation between nominal and actual range. If the signal supplied to the alarm comparator 102 by the ultrasonic motion sensor 100 is greater than the adaptive alarm threshold voltage, $V_T$, the processor is operative to provide an alarm indication representative of object motion within the stabilized range of the ultrasonic motion detector.

Figure 5:
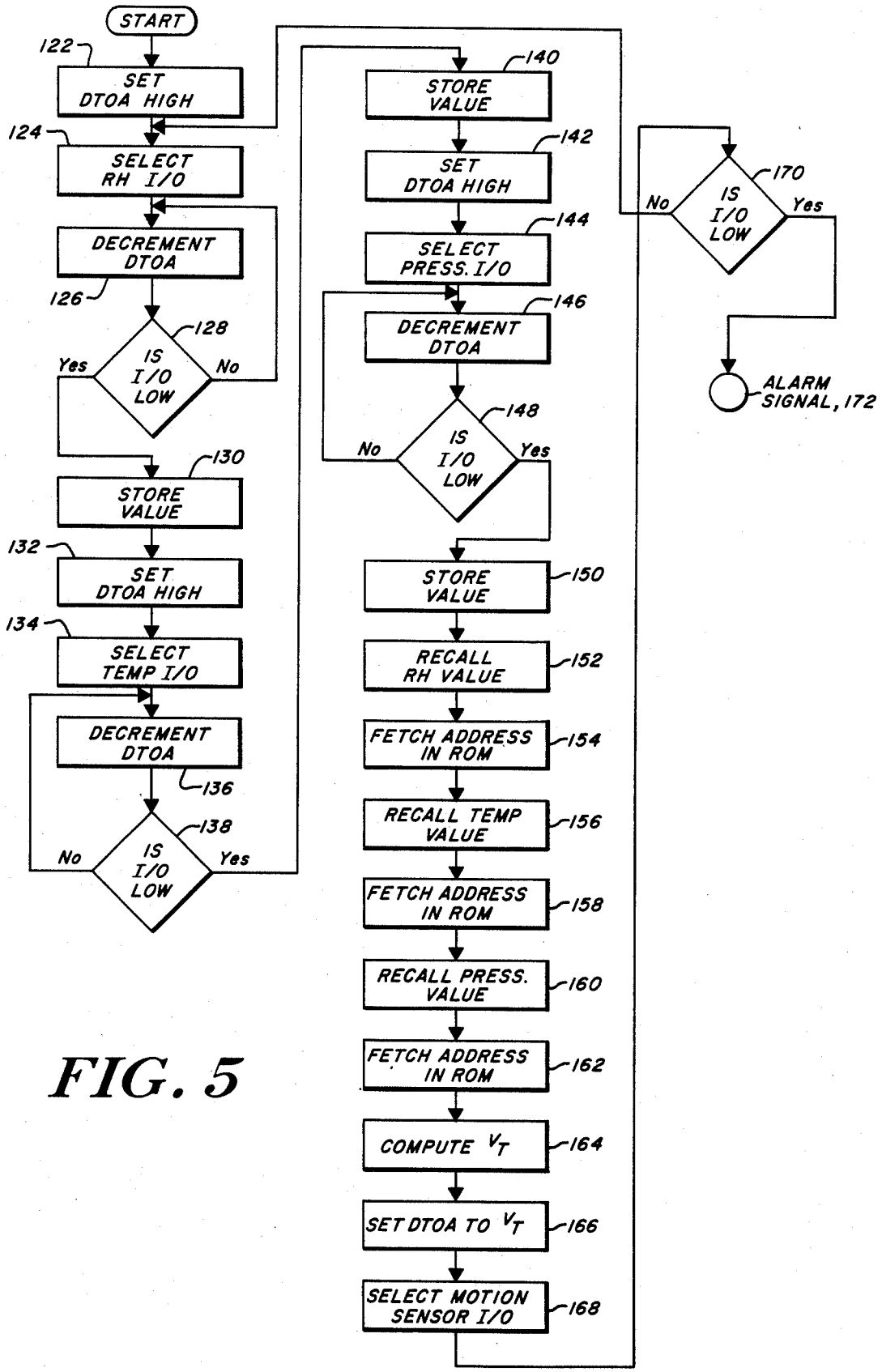
FIG. 5 is a flow chart illustrating the operation of the embodiment of FIG. 4.

Referring now to FIG. 5, which shows a flow chart illustrating the operation of the microprocessor, the processor is operative to set the DTOA 116 output over line 120 to its highest voltage as shown as step 122 and selects and monitors the I/O terminal which corresponds to the relative humidity sensor 104 (FIG. 4) as shown as step 124. The processor is then operative to sequentially decrement the DTOA output signal applied over line 120 (FIG. 4) as shown as step 126 and monitor the state of the I/O terminal which is connected to the relative humidity comparator 110 (FIG. 4) as shown as step 128. The digital value which corresponds to the signal being produced by the DTOA at the time of a state change of the comparator 110 (FIG. 4) is stored in RAM as shown as step 130. This value represents the ambient percent relative humidity factor of the atmosphere.

The processor is then operative to set the DTOA output again to its highest voltage as shown as step 132 and selects and monitors the I/O terminal which corresponds to the temperature sensor 106 (FIG. 4) as shown as step 134. The processor is then operative to sequentially decrement the DTOA output signal applied over line 120 (FIG. 4) as shown as step 136 and to monitor the state of the I/O terminal which is connected to the comparator 112 (FIG. 4) as shown as step 138. The digital value which is being produced by the DTOA at the time of a state change of the comparator 112 is stored in RAM as shown as step 140. This value represents the ambient temperature parameter of the atmosphere.

The processor is then operative to set the DTOA output over line 120 (FIG. 4) once again to its highest voltage as shown as step 142 and selects and monitors the I/O terminal which corresponds to the pressure sensor 108 (FIG. 4) as shown as step 144. The processor is then operative to sequentially decrement the DTOA output signal applied over the line 120 (FIG. 4) as shown as step 146 and to monitor the state of the I/O terminal which is connected to the comparator 112 (FIG. 4) as shown at 148. The digital value which corresponds to the signal being produced by the DTOA at the time of a state change of the comparator 112 is stored in RAM as shown at 150. This value represents the ambient pressure of the atmosphere.

The processor is then operative to recall the relative humidity digital data that corresponds to ambient atmospheric relative humidity and to recall from ROM the range data that corresponds thereto as shown as steps 152 and 54. The processor then recalls, in a like manner, the ambient temperature data and range data corresponding thereto as shown as steps 156 and 158, and then recalls the ambient pressure data and the range data that corresponds thereto as shown as steps 160 and 162. The processor is then operative to compute that threshold value, $V_T$, which corresponds to the variation between the nominal range and the effective range determined by the ambient atmospheric condition of the sound propagation medium as shown as step 164.

As shown as step 166, the processor is then operative to set the output of the DTOA 116 to the computed threshold voltage ($V_T$) which is applied over the line 120 to the alarm comparator 102. As shown at 168, the processor is then operative to select the I/O terminal that corresponds to the alarm comparator and to produce an alarm signal if the output signal of the ultrasonic motion sensor 100 has a level that is greater than the level of the computed comparator threshold ($V_T$) as shown as steps 170 and 172. Otherwise, the cycle is repeated.

It is to be understood that many modifications of the presently disclosed invention may be effected without departing form the scope of the appended claims.

What is claimed is:

1. An intrusion detection system, comprising:

an ultrasonic motion detector for providing an alarm signal in response to object motion within a range that varies from nominal range with the variation between ambient atmospheric condition and nominal atmospheric condition of the atmospheric sound propagation medium;

an ambient atmospheric condition sensor for providing sensor signals which respectively depend upon at least two distinct ambient atmospheric conditions of the atmospheric sound propagation medium;

means responsive to said sensor signals for combining said sensor signals to provide a range compensation signal which depends on the difference between nominal and ambient atmospheric conditions; and means for applying said range compensation signal to said ultrasonic motion detector to adapt said effective range to said nominal range.

2. An intrusion detection system, as recited in claim 1, wherein said ultrasonic motion detector includes:

an ultrasonic motion sensor operative to produce an object detect signal in response to said object motion; and an alarm threshold comparator having an input responsive to said object detect signal and another input responsive to said range compensation signal.

3. An intrusion detection system, as recited in claim 1, wherein said ultrasonic motion detector includes:

an ultrasonic motion sensor including a signal amplifier means operative to provide an object detect signal in response to object motion within said range; and wherein said range compensation signal is operatively connected to said signal amplifier means to controllably vary the gain of said amplifier means.

4. An intrusion detection system, as recited in claim 2 or 3, wherein said range compensation signal is provided by an analog summing amplifier that weights and adds said sensor signals.

5. An intrusion detection system, as recited in claim 4, wherein said ambient atmospheric condition sensor includes a temperataure sensor, a pressure sensor, and a relative humidity sensor.

6. An intrusion detection system, as recited in claim 2 or 3, wherein said range compensation signal is provided by a digital microprocessor operative in response to said sensor signals to calculate said range compensation signal therefrom.

7. An intrusion detection system, as recited in claim 6, wherein said ambient atmospheric condition sensor includes a temperatuare sensor, a pressure sensor, and a relative humidity sensor.

8. An intrusion detection system, as recited in claim 6, further including memory operatively connected to said digital microprocessor; wherein said ambient atmospheric sensor has at least two ambient atmospheric condition sensors; further including at least two comparators, one input of each being respectively connected to a corresponding one of said at least two ambient atmospheric condition sensors, the other input of each being respectively operatively connected to an output port of said digital microprocessor, with the output of each of said comparators being operatively connected to an input of said digital microprocessor; wherein said microprocessor is operative to read each of said comparators by decrementing a signal at its corresponding output and writing the value therefrom in said memory when the comparator threshold is exceeded to a preselected address location selected to correspond to an associated comparator; and wherein said microprocessor is operative to read the values from the corresponding addresses in memory and to calculate therefrom said range compensation signal.

9. A range compensated ultrasonic intrusion detection system, comprising:

an ultrasonic motion detector responsive to object motion within the actual range of the ultrasonic motion detector for providing a signal representative of object motion within the actual range;

means responsive to the level of said signal for providing an alarm signal indicating object motion within said range whenever said level exceeds a threshold level selected for a nominal range and noise performance;

an ambient atmospheric sensor responsive to the sound propagation parameters of the ambient atmosphere for providing at least two sensor signals respectively representative of at least two distinct ambient sound propagation parameters; and means responsive to a predetermined combination of said sensor signals and coupled to said ultrasonic motion detector, for changing at least one of said levels in a first direction if the actual range of said ultrasonic motion detector is less than the nominal range and for changing at least one of said levels in a second direction opposite the first direction if the actual range of the ultrasonic motion detector is greater than the nominal range.

10. A range compensated ultrasonic intrusion detection system, as recited in claim 9, wherein said ambient atmospheric sensor changes said level of said signal representative of object motion in response to the variation between ambient atmospheric condition and nominal atmospheric condition.

11. A range compensated ultrasonic intrusion detection system, as recited in claim 9, wherein said ambient atmospheric sensor changes said threshold level of said level responsive means in response to the variation between ambient atmospheric atmospheric condition and nominal atmospheric condition.

12. A range compensated ultrasonic motion detector, as recited in claim 11, wherein said level responsive means is a threshold comparator.

13. A range compensated ultrasonic intrusion detection system, as recited in claim 10 or 11 wherein said ambient atmospheric sensor includes an ambient temperature, pressure, and relative humidity sensing means coupled to an analog summing network operative to selectively add and weight said signals to provide said levels.

14. A range compensated ultrasonic intrusion detection system as recited in claim 10 or 11 wherein said ambient atmospheric sensor includes an ambient atmospheric temperature, pressure, and relative humidity sensing means operatively connected to a microprocessor operative to provide said levels.

15. An ultrasonic motion detector system that is substantially free of both false alarms and failure-of-alarm situations, comprising:

an ultrasonic motion sensor having a preselected nominal range and an actual range that varies with the sound wave attenuation coefficient of the ambient condition of the atmospheric propagation medium for providing an object detection signal representative of object motion within said actual range;

means including an ambient atmospheric sensor for providing an ambient atmospheric sensor signal representative of a predetermined combination of at least two selected different ambient atmospheric conditions that affect the sound wave attenuation coefficient; and means coupled to said ultrasonic motion sensor and responsive to said object detection signal and to said ambient atmoshperic sensor signal for providing an alarm signal that indicates object motion within said actual range adapted to said nominal range such that whenever ambient atmospheric conditions produce an actual range that is spatially less extended than nominal range said actual range is effectively extended to said nominal range, and whenever the ambient atmospheric condition produces an actual range that is spatially greater in extent than said nominal range said actual range is effectively contracted to said nominal range thereby substantially eliminating said failure-of-alarm and said false alarm situations, respectively.

16. An ultrasonic motion detection system that is substantially free of both false alarms and a failure-of-alarm situation, as recited in claim 15, wherein said ambient atmospheric sensor includes a temperature sensor for providing a signal representative of the ambient temperature of the atmospheric sound propagation medium.

17. An ultrasonic intrusion detection system that is substantially free of both false alarms and a failure-of-alarm situation, as recited in claim 15, wherein said ambient atmospheric sensor includes a pressure sensor for providing a signal representative of the ambient pressure of the atmospheric sound propagation medium.

18. An ultrasonic intrusion detection system that is substantially free of both false alarms and a failure-of-alarm situation, as recited in claim 15, wherein said ambient atmospheric sensor includes a relative humidity sensor for providing a signal representative of the ambient percent relative humidity of the atmospheric sound propagation medium.

19. An ultrasonic intrusion detection system that is substantially free of both false alarms and a failure-of-alarm situation, as recited in claim 15, 16, 17, or 18, wherein said sensor signal providing means includes an analog summing network and an alarm threshold comparator, said alarm threshold comparator having one input thereof responsive to said object detection signal and another input thereof responsive to the output of said analog summing network so that the level of said comparator is adapted to ambient conditions.

20. An ultrasonic intrusion detection system that is substantially free of both false alarms and a failure-of-alarm situation, as recited in claim 19, wherein said sensor signal providing means includes an analog summing network and an amplifier responsive to said object detection signal, the output signal of said analog summing network being operatively connected to control the gain of said amplifier so that the gain thereof is adapted to ambient conditions.

21. An ultrasonic intrusion detection system that is substantially free of both false alarms and a failure-of-alarm situation, as recited in claim 15, 16, 17, or 18, wherein said alarm signal providing means includes a microprocessor responsive to said ambient atmospheric sensor signal and an alarm threshold comparator, one input of said alarm threshold comparator being responsive to said object detect signal and another input thereof being responsive to the output signal of said microprocessor.

22. An ultrasonic intrusion detection system that is substantially free of both false alarms and failure-of-alarm situations, as recited in claim 8, further including memory operatively connected to said digital microprocessor; wherein said ambient atmospheric sensor has at least two ambient atmospheric condition sensors; further including at least two comparators, one input of each being respectively connected to a corresponding one of said at least two ambient atmospheric condition sensors, the other input of each being operatively connected to an output of said digital microprocessor, and the output of each of said comparators being operatively connected to an input of the microprocessor; wherein said microprocessor is operative to read each of said comparators by decrementing a signal at its corresponding output and writing a value therefrom in said memory when the comparator threshold is exceeded to a predetermined address location selected to correspond to an associated comparator; and wherein said processor is operative to read the values from the corresponding addresses in memory and to calculate said sensor signal by combining the data at the corresponding locations.

* * * * *